United States Patent [19]

Rummel et al.

[11] Patent Number: 4,680,948

[45] Date of Patent: Jul. 21, 1987

[54] DRYER MOUNTING BRACKET ASSEMBLY

[75] Inventors: Raymond W. Rummel, Webster City; Anthony A. Crystal, Stratford, both of Iowa

[73] Assignee: White Consolidated Industries, Inc., Cleveland, Ohio

[21] Appl. No.: 690,314

[22] Filed: Jan. 10, 1985

[51] Int. Cl.[4] ..... D06F 37/20

[52] U.S. Cl. ..... 68/3 R; 312/198

[58] Field of Search ..... 248/121, 309.1, 201, 248/639; 312/198; 68/3 R, 19.2, 20

[56] References Cited

U.S. PATENT DOCUMENTS

| | | | |
|---|---|---|---|
| 1,585,102 | 5/1926 | Langdon | 312/198 X |
| 1,763,306 | 6/1930 | Hendrickson | 312/198 X |
| 1,880,733 | 10/1932 | Bolnuis | 312/198 |
| 2,218,300 | 10/1940 | Schuster | 312/205 X |
| 2,793,518 | 5/1957 | Geldnof | 312/198 X |
| 4,454,732 | 6/1984 | Burkland et al. | 68/3 R |
| 4,507,942 | 4/1985 | Hirose et al. | 68/20 |

FOREIGN PATENT DOCUMENTS

| | | | |
|---|---|---|---|
| 1091825 | 11/1954 | France | 248/309.1 |
| 59-11892 | 1/1984 | Japan | 68/20 |

*Primary Examiner*—Philip R. Coe
*Assistant Examiner*—Frankie L. Stinson
*Attorney, Agent, or Firm*—Pearne, Gordon, McCoy & Granger

[57] ABSTRACT

A bracket assembly is provided to allow for vertical mounting of a washer and dryer to form a laundry center. The assembly includes a left and right mounting bracket. The mounting brackets each have a lower mounting flange which joins a lower leg to form a lower angle. The lower angle cooperates with the top edge of the lower appliance. The brackets also have a back rib which forms a second layer angle which cooperates with the back edge of the lower appliance. The brackets also have a top mounting flange which joins an upper leg to form an upper angle which cooperates with the bottom edge of the top appliance and support means extending between the upper and lower mount flanges. An optional removable back plate extends between the mount brackets to give the assembly a unitary appearance.

20 Claims, 7 Drawing Figures

DRYER MOUNTING BRACKET ASSEMBLY

BACKGROUND OF THE INVENTION

This invention relates generally to domestic appliances, and more particularly to a combined clothes washer and dryer unit and a bracket assembly which allows for vertical stacking of washers and dryers, wherein the dryer is of a front loading type and the washer of a top loading type.

It is an advantage to have a washer and dryer stacked one on top of the other because this arrangement allows for savings in space. It also presents extra convenience to the user in loading the clothes from the washer into the dryer by saving steps between the appliances.

There is little problem when the washer is of the front loading type, since the dryer can be fastened directly on top of the washer, which, being much heavier than the dryer, is necessarily on the bottom. However, because of the high cost of front loading washers, top loading washers are far more popular even though they create a problem in providing access to the top of the washer.

One approach to allowing access to the washer top is to mount the washer on rollers and the dryer on a frame resting on the floor surrounding the washer. This requires the washer to be physically moved outward from beneath the dryer to allow access to the top.

Another approach has been to provide a frame in which the washer rests either on the floor or on the frame and the dryer is supported a spaced distance above the washer by the frame, as shown in U.S. Pat. Nos. 4,454,732 to Burkland et al. and 4,462,225 to Doe.

Still another approach is to build a single integral unit in which the dryer mechanism is positioned to allow the bottom of the dryer cabinet to be slanted inward to allow access to the washer, as shown in U.S. Pat. No. 3,545,235 to N.A. Menk and B. Brucken.

SUMMARY OF THE INVENTION

The present invention has the object of providing a compact, easy-to-manufacture and easily assembled bracket assembly which will support the dryer directly on the washer cabinet so that the tub of a top loading washer is accessible to the user. The appliances are conventional, free-standing standard or compact size washers and dryers with some minor modification.

The present invention provides a bracket assembly which will give the appearance of a single unit with the dryer stacked above the washer and will function in the same way, but which can be used with individual appliances. It saves expense in the transportation of the washer and dryer to transport individual units, as opposed to a larger single unit. It also represents a savings in the manufacture of the washer and dryer to use the conventional standard washer and dryer, or compact washer and dryer, with a slight modification, and to have a bracket assembly to provide the stacked relationship, rather than to manufacture the washer and dryer as a single unit. Being able to use a relatively standard washer and dryer allows the manufacturer to easily switch between manufacture of the standard and stackable units to account for shifts in consumer demand and inventory without a great deal of change in the manufacturing process or machinery.

The invention also provides for easy assembly of the washer and dryer unit by a person relatively inexperienced in the assembly of the unit, e.g., an appliance delivery man, an appliance store owner, or the ultimate consumer.

A further object of the invention is to allow for the mounting of the dryer above the washer in a parallel relationship while providing for various horizontal alignments of the dryer and washer to allow for storage areas of varying size and depth.

Further, the invention provides access to electrical and water outlets located behind the washer and dryer. It is otherwise difficult to obtain access to the electrical and water outlets for integral washer and dryer units positioned in enclosed areas.

Finally, the bracket assembly must be capable of secure support of the dryer while withstanding the additional kinetic forces created when the washer and dryer are in operation.

The invention includes a right and a left mounting bracket. The mounting brackets each have an upper flange which has a surface on which the dryer is mounted. A leg or lip extends upwardly from the outer edge of the flange surface to form an upper angle which accommodates the bottom corner of the dryer cabinet.

A lower mounting flange also has a mounting surface and a lower leg or lip extending downwardly at the outer edge of the mounting surface to form a lower angle to accommodate the top edge of the washer cabinet. The dryer is supported by the upper and lower flanges. There is a vertical back rib which is perpendicular to both the lower leg and the lower flange to form a second lower angle which cooperates with the back side of the washer cabinet so that the corner of the washer meets the junction of the back rib, the lower leg, and the lower flange.

Support is provided between the two flanges which is sufficient to bear the weight of the dryer.

The upper flange extends rearwardly beyond the inner face of the back rib so that the dryer may be mounted with its front wall behind the plane of the front wall of the washer.

A plate is provided which extends transversely from the right mounting bracket to the left mounting bracket and vertically from the washer to the dryer to close off the vertical space between the washer and dryer and create the look of a single unit. The plate is mounted on ribs disposed in the mounting brackets.

The various features of the bracket assembly will become evident as the description proceeds and from an examination of the accompanying drawings.

DESCRIPTION OF THE PREFERRED EMBODIMENT

Figure 1:
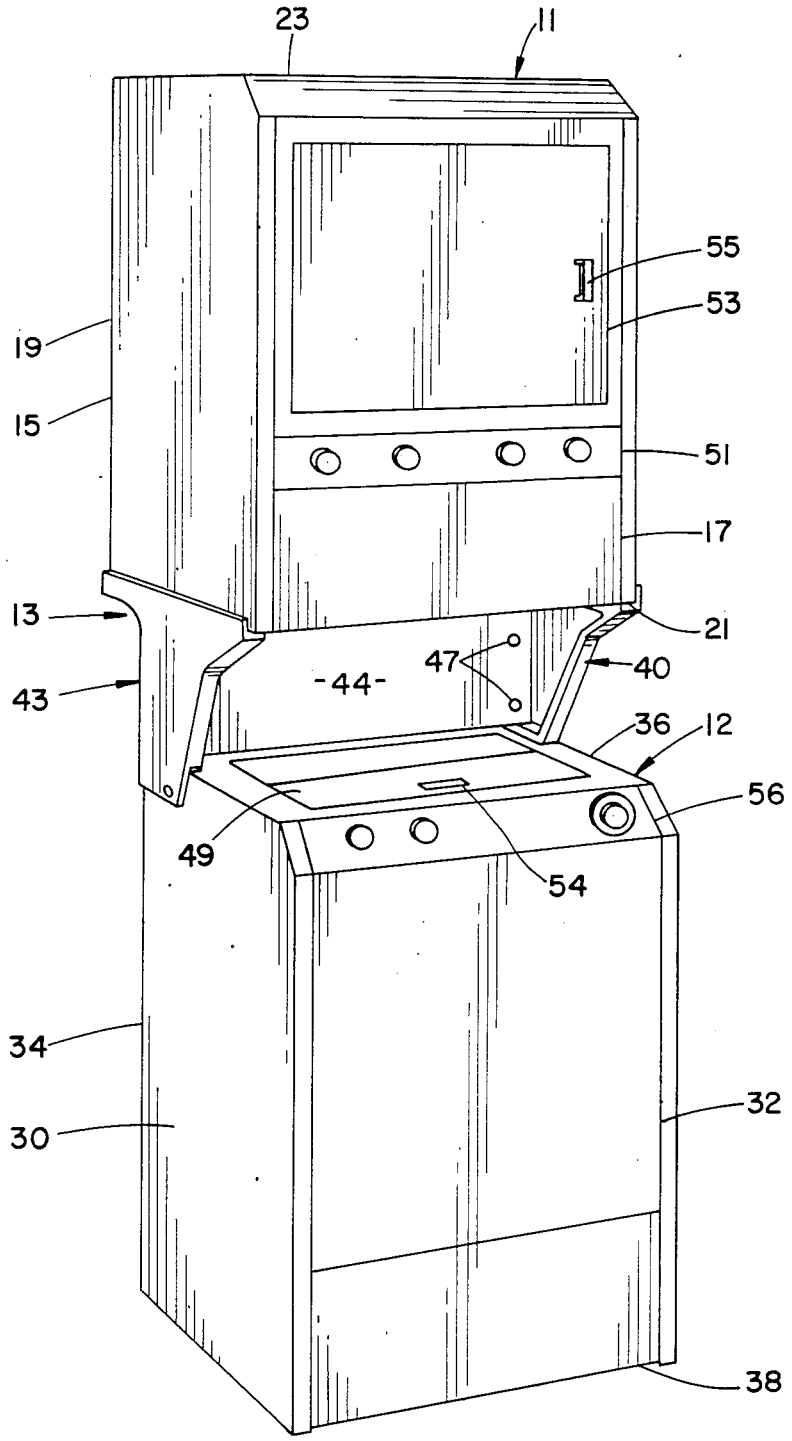
FIG. 1 is a perspective view of a dryer mounted on a washer using the bracket assembly in accordance with the present invention.

A clothes dryer 11 is mounted in a vertical relationship to a clothes washer 12 by means of a bracket assembly 13. The dryer 11 has a conventionally formed sheet metal cabinet including vertical side walls 15, a vertical front wall 17, a vertical back wall 19, and a base 21 as well as a top wall 23 which are perpendicular to the side, front, and back walls. The dryer has a door 53 mounted in the front wall and hinged on one side and having a handle 55. The control panel 51 is located below the door 53 so that when the dryer is in position above the washing machine, the control panel 51 is easily accessible. The positioning of the control panel represents a modification of the conventional free-standing dryers. The dryer is otherwise relatively free of modification from the conventional free-standing dryer.

The washing machine 12 also has a conventionally formed sheet metal cabinet including two vertical sidewalls 30, a vertical front wall 32, a vertical back wall 34, and a top 36 perpendicular to the side, front, and back walls. The top 36 has a door 49 which is, in this case, a bifold door, having a recessed handle 54. The bifold door is designed to decrease the height requirement between appliances while maintaining accessibility to the washer tub. A control panel 56 is located in an area which is easily accessible to the user after assembly. With the exception of the bifold door, the washer is relatively free of modification from the conventional free-standing washer.

The bracket assembly 13 includes a right mounting bracket 40 and a left mounting bracket 43 joined by a back plate 44.

Figure 2:
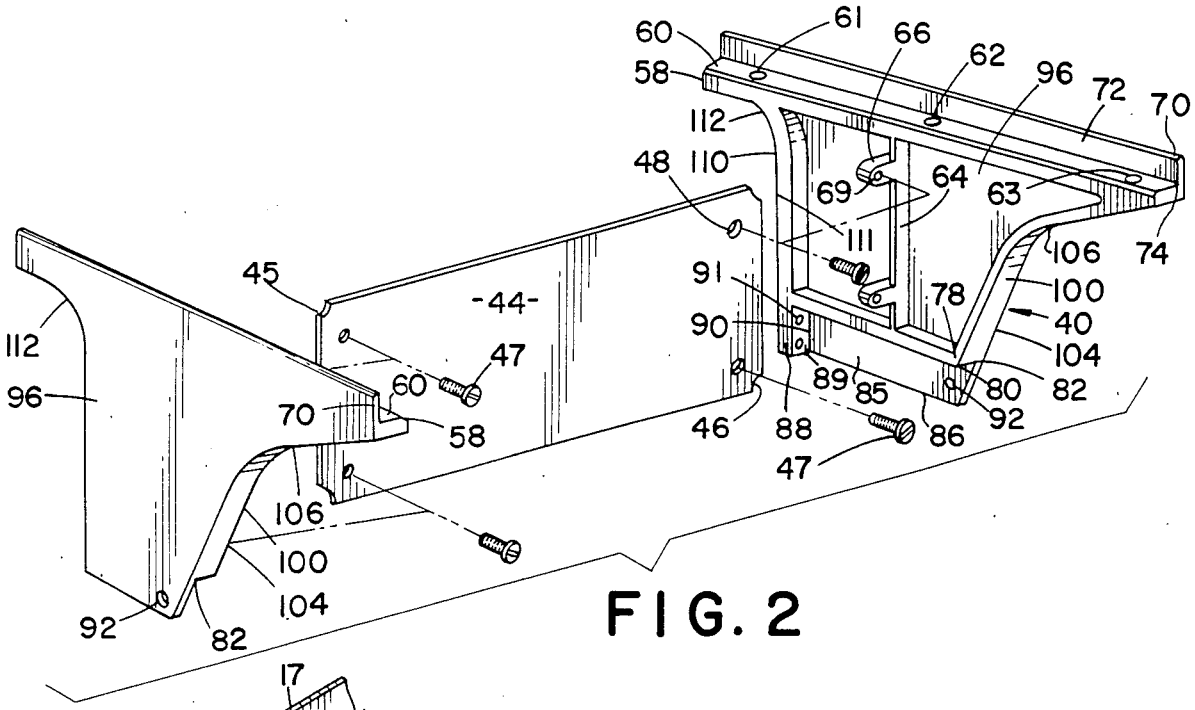
FIG. 2 is an exploded, perspective view of the bracket assembly.
Figure 3:
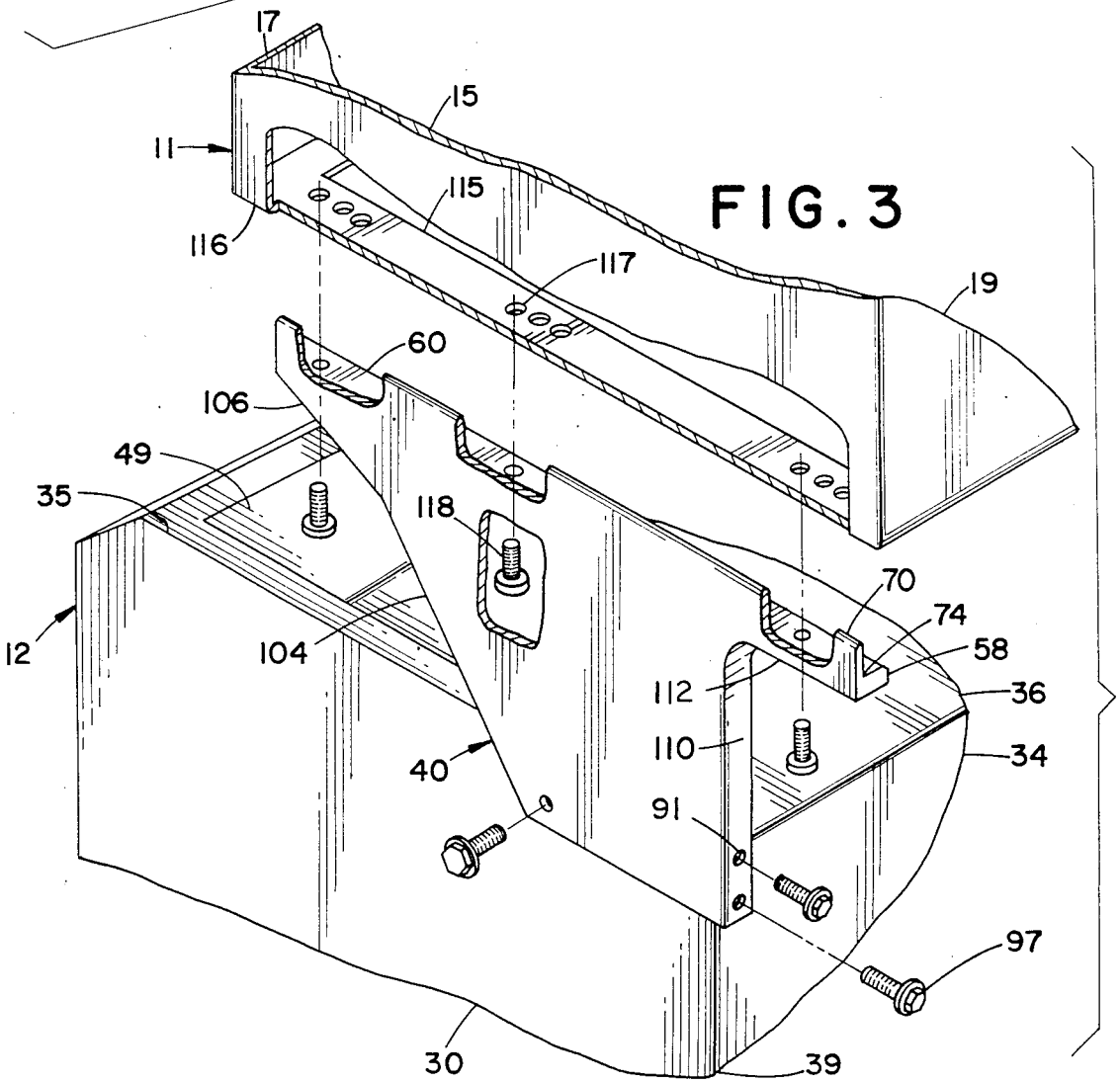
FIG. 3 is another exploded, perspective view of the dryer mounted on the washer, using the bracket assembly.
Figure 6:
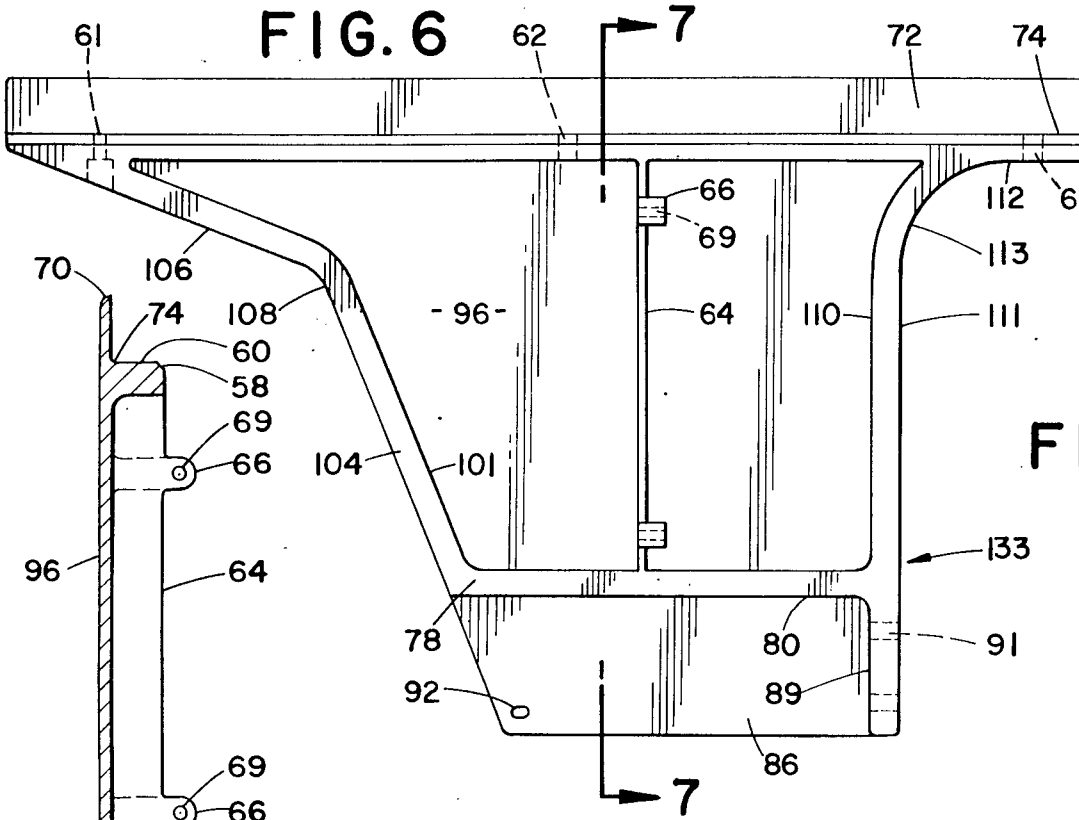
FIG. 6 is a side elevational view of the bracket.
Figure 5:
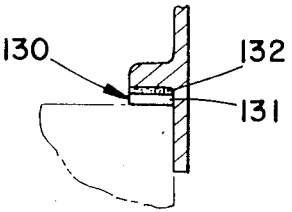
FIG. 5 is an enlarged view of the bracket mounted on the washer taken along line 5—5 of FIG. 4.
Figure 7:
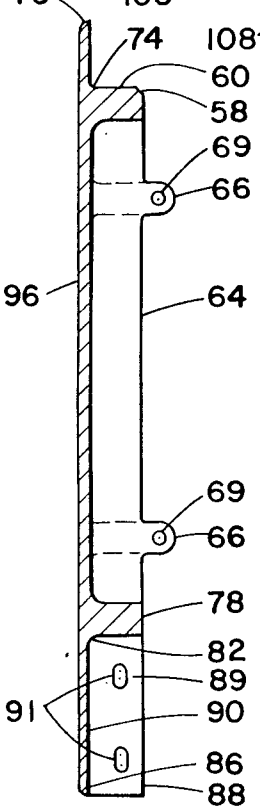
FIG. 7 is a cross section of the bracket taken along line 7—7 of FIG. 6.

As seen in FIGS. 2 and 6, the mounting brackets include an upper mounting flange 58, the top side of which forms a dryer mounting surface 60. The bottom of the dryer cooperates with this surface. An upper lip or leg 70 extends along the length of the flange 58 and has an inside face 72 at a right angle with the mounting surface 60 to form an upper angle 74. The leg 70 allows the dryer to be aligned on the brackets during assembly. It also secures the dryer against sidewise shifting in response to motion of the washer or dryer during use, especially motion caused by improper loading. The upper flange 58 includes rear aperture 61, a middle aperture 62, and a front aperture 63 in order to secure the dryer to the mounting bracket.

The brackets have a lower mounting flange 78 the bottom face of which forms a washer mounting surface 80. This surface 80 cooperates with the top 36 of the washer. The brackets also have a lower lip or leg 86 having an inside face 85 at a right angle to the mounting surface 80 to form a lower angle 82. The upper edge of the washer formed between the top 36 of the washer and one of the vertical side walls 30 cooperates with the angle 82 when the bracket is in position on the washer 12. The lower leg 86 similarly allows the brackets to be properly aligned on the washer and secures the bracket assembly against sidewise shifting in response to the motion of the washer or dryer during use.

A rear rib 88 having an inside face 89 forms right angles with the washer mounting surface 80 and the lower leg 86. The rear rib 88 further provides for proper alignment of the brackets and stability against motion when the appliances are in use. A rear angle 90 is formed between the rear rib 88 and the lower leg 86. Holes 91 are provided in the ribs 88 to secure the bracket to the rear wall of the washer 12 by means of bolts 97. The washer is provided with corresponding holes (not shown). A further hole 92 is provided at the front of the leg 86 to mount the bracket, using a bolt, to the side of the washer. The washer is provided with a corresponding hole (not shown) which is plugged if the invention is not used.

The top flange 58 is held in a spaced, parallel relation to the bottom flange 78 by a front support web 100. The web 100 has a front vertical portion 104 which flows into a front buttress 106. The front buttress 106 joins the upper flange 58.

A back support web 110 includes a rear vertical portion 111 which extends upward from the rear rib 88 and flows into a rear buttress 112. The rear buttress 112 joins the rear of the upper flange 58. A sheathing 96 forms an exterior bracket wall.

An intermediate rib 64 extends between the bottom flange 78 and the top flange 58. The intermediate rib 64 includes mounting tabs 66 having holes 69 which accommodate screws 47 to hold the back plate 44 in place. The back plate 44 has notches 45 in the upper right and left corners for the upper flanges 58. It also has notches 46 in the lower right and left corners to accommodate the lower flanges 78. The back plate 44 includes holes 48 for the screws 47.

The washer mounting surface 80 includes a scratch protector 130. The scratch protector includes a felt layer 131 and an adhesive layer 132 which holds the felt layer 131 to the mounting surface 80. The scratch protector 130 extends along the washer mounting surface 80 and protects the top wall 36 of the washer 12. This keeps the top wall of the washer 12 from being scratched so that it may be used at a later point as a freestanding unit. This also provides additional friction to hold the bracket assembly in place on the washer 12.

The washer 12 and dryer 11 are stacked using the bracket assembly as follows. The brackets 40 and 43 are mounted on the top wall 36 of the washer 12 so that the inside faces 85 of the lower legs 86 cooperate with the vertical walls 30 of the washer 12. The washer mounting surface 80 cooperates with the top 36 of the washer 12, and the inside faces 89 of the back ribs 88 cooperate with the back walls 34 of the washer 12.

The top edges 35 of the washer 12 cooperate with each of the lower angles 82 of the mounting brackets. The back edges 39 of the washer cooperate with the rear angle 90 of the mounting brackets.

The base 21 of the dryer 11 cooperates with the dryer mounting surface 60. Specifically, the base 21 of the dryer includes a rim 115 which is sufficient to bear the weight of the dryer 11. The rim 115 cooperates with the dryer mounting surfaces 60. The rim 115 includes holes 177. Multiple holes allow for variable positioning of the dryer. The bottom edge 116 of the dryer 11 cooperates with the top angle 74 of the mount brackets 40 and 43.

The back plate 44 is mounted to the left and right mount brackets 40 and 43 to each back plate support rib 64. The back plate 44 extends the length of the back wall 34 of the washer 12 and the height between the washer 12 and the dryer 11. The back plate 44 is secured to projecting tabs 66 on the support rib 64 by means of screws 47 extending through holes 48 in the back plate. The result of the back plate 44 is to give the bracket assembly a unitary appearance from the washer 12 to the dryer 11. It also provides some stiffening and vertical integrity of the bracket assembly.

It is an advantage for the bracket assembly to include a removable back plate. This plate can be removed to allow access to the water and electrical outlets behind the washer and dryer when the washer/dryer unit is installed in a closet or enclosed area designed or modified for a laundry center. If a single unit washer/dryer or a unit where the dryer sits directly on the washer is used, the laundry center must be removed from the enclosed area to allow access to the water and electrical outlets.

The bracket includes a sheathing 96 that extends between the front support web 100 and the rear support web 110, and forms a continuous part of the upper leg 70 and the lower leg 86. Thus, the exterior of the mount bracket is smooth and presents an exterior surface which, when positioned beween the washer and dryer, is similar to that of a single unit washer/dryer.

The upper bracket 60 includes holes 61, 62, and 63 which cooperate with holes 117 in the bottom rim 115 of the dryer. Screws 118 secure the bottom rim 115 of the dryer to the upper flange 58. The holes may be positioned so that the dryer may be spaced at different points in relation to the washer along the upper mount surface 60 of the brackets.

The back rib 88 includes holes 91 so that the back rib can be secured to the back wall 34 of the washer 12 by means of screws 97.

A hole 92 may also be provided in the lower leg 86 so that each bracket 40, 43 may be secured to the sidewalls 30 of the washer 12.

The lower portion 133 of the mounting bracket, including the lower flange 78 which cooperates with the washer, extends along the washer 12 substantially less than the total distance of the depth of the washer 12, and preferably less than half the depth of washer 12, so that there is sufficient access to the washer tub when the bifold door 49 is in an open position. The bifold door 49 has a front section 126 and a back section 125 which pivot relative to each other at pivot point 127.

In addition, the mount brackets 40, 43 each include a front indentation 108 formed where the vertical portion 104 joins the front buttress portion 106. This indentation 108 allows the user to have more room to access the washer tub.

The top portion of the mount bracket 135 extends to the front and back beyond the bottom portion 133 of the mount bracket.

The bracket assembly, and particularly the mount brackets, may be made of any material of suitable strength to support the weight of the dryer and to withstand the additional kinetic forces created during operation of the appliances. Such a material is a modified polyphenylene oxide-based resin, such as NORYL, manufactured by General Electric Company. Preferably, the material is the same color as the appliance cabinets or is enameled or painted to match.

The dryer 11 may be placed at various positions along the length of the brackets 40 and 43. For example, where space is a problem, the dryer 11 may be placed with the plane of the front wall 17 of the dryer 11 relatively close to the plane of the front wall 32 of the washer 12. This provides for a shallower silhouette of the unit. Where space is less of a problem, the dryer 11 may be placed further back on the bracket 40 so that the plane of the front wall 17 of the dryer 11 is spaced further from the plane of the front wall 32 of the washer 12. In this position, the user has a greater access area to the tub of the washer 12.

Figure 4:
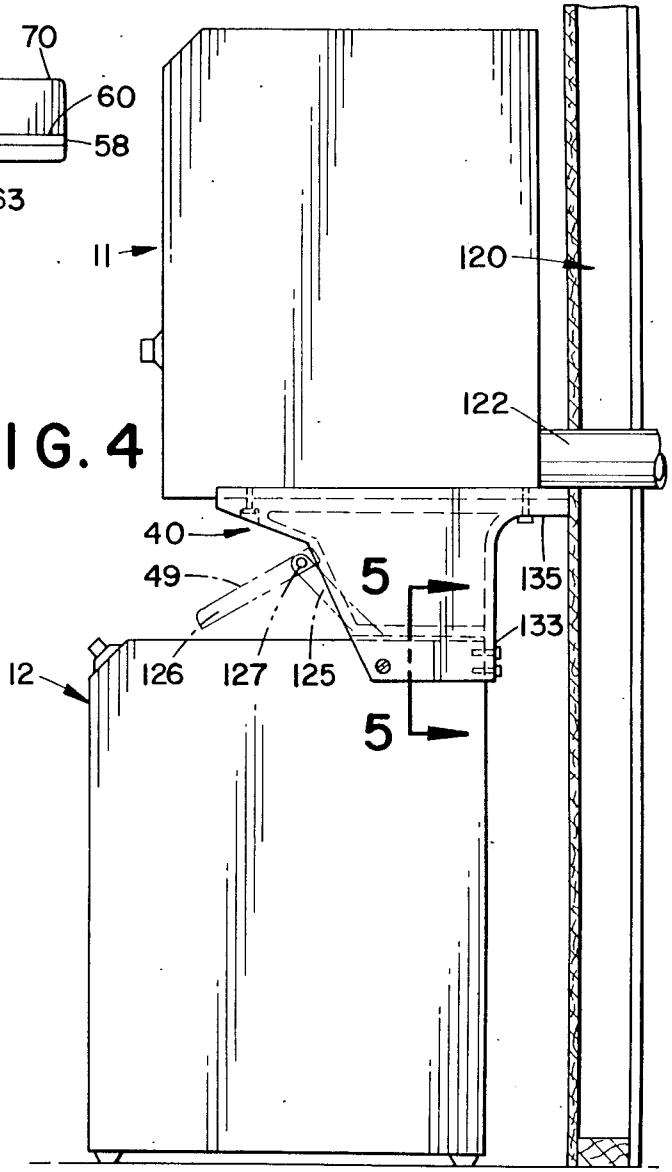
FIG. 4 is a side elevational view of the dryer mounted on the washer.

The dryer 11 includes an exhaust pipe 122 which extends outward from the dryer 11, for example, through an exterior room wall 120, as shown in FIG. 4.

Although the preferred embodiment of this invention has been shown and described, it should be understood that various modifications and rearrangements of the parts may be resorted to without departing from the scope of the invention as disclosed and claimed herein.

What is claimed is:

1. A bracket assembly to provide for vertical mounting of a top appliance having a base and two vertical side surfaces and a bottom appliance having a top horizontal surface and two vertical side surfaces and a vertical back surface, comprising two mounting brackets each having:

a lower flange having a bottom side which defines a lower mounting surface to engage the top horizontal surface of the bottom appliance;

a lower leg extending integrally downward from the lower flange and forming a lower inside face to engage the adjacent side surface of the bottom appliance, said lower inside face being substantially perpendicular to said lower mounting surface and joining the lower mounting surface to form a lower horizontal angle;

a back rib extending integrally downward from the lower flange and forming a back inside face to engage the vertical back surface of the bottom appliance, said back inside face being substantially perpendicular to the lower inside face of the leg and joining said lower inside face to form a lower vertical angle;

an upper flange having a top side which defines an upper mounting surface to engage the base of the top appliance;

an upper leg extending integrally upward from the upper flange and having an inside face to engage the adjacent vertical side surface of the top appliance, said upper face being substantially perpendicular to said upper mounting surface and joining the upper mounting surface to form an upper horizontal angle; and supporting means joining the upper flange to the lower flange in a spaced parallel relationship and being capable of supporting the top appliance.

2. The bracket assembly as set forth in claim 1, wherein said supporting means includes a bracket wall extending between the upper flange and the lower flange.

3. The bracket assembly as set forth in claim 2, wherein said upper leg and said lower leg form a continuous extension of the bracket wall.

4. The bracket assembly as set forth in claim 1, wherein said upper flange projects beyond said lower flange.

5. The bracket assembly as set forth in claim 4, wherein said supporting means comprise a front vehicle portion which intersects said lower flange and which flows into a front buttress joining said upper flange, and a rear vertical portion which extends upwardly from said back rib and intersects said lower flange and which flows into a rear buttress member which joins said upper flange.

6. The bracket assembly as set forth in claim 1, further comprising a removable plate which cooperates with both mounting brackets.

7. The bracket assembly as set forth in claim 6, wherein each of said mounting brackets includes an intermediate rib which extends between said lower flange and said upper flange to support said plate.

8. The bracket assembly as set forth in claim 1, wherein said lower mounting surface includes means to protect the appliance top surface from scratches.

9. The bracket assembly as set forth in claim 1, wherein said means to protect the appliance surface comprises a pad having a pressure-sensitive adhesive layer to join the pad to the lower mounting surface.

10. A combined washer and dryer unit comprising:

a lower appliance having front, back, and side walls joined to a top surface;

an upper appliance having front, back and side walls joined to a base;

a right and left mounting bracket each having a lower flange having a bottom side defining a lower mounting surface which engages the top surface of the lower appliance;

a lower leg extending integrally downward from the lower mounting surface and having an inside face engaging an adjacent side wall of said lower appliance;

a back rib perpendicular to the lower leg and the lower mounting surface and extending integrally downward from the lower mounting surface, and engaging the back wall of the lower appliance;

an upper flange having a top side defining an upper mounting surface which engages the base of the upper appliance;

an upper leg joining the upper flange and extending integrally upward from the upper mounting surface, the upper leg having an inside face which engages an adjacent side wall of the upper appliance;

supporting means joining the upper flange to the lower flange in a spaced parallel relationship and being capable of supporting the top appliance.

11. The combined washer and dryer unit as set forth in claim 10, wherein said supporting means includes a bracket wall extending between the upper flange and the lower flange.

12. The combined washer and dryer unit as set forth in claim 11, wherein said upper leg and said lower leg form a continuous extension of the bracket wall.

13. The combined washer and dryer unit as set forth in claim 10, wherein the lower appliance includes a bifold door covering an opening in the top surface and the plane of the front wall of the upper appliance is spaced back from the plane of the front wall of the lower appliance to provide for accessibility of the bifold door opening.

14. The combined washer and dryer unit as set forth in claim 13, wherein the plane of the front wall of the upper appliance can be spaced at different distances from the plane of the front wall of the lower appliance.

15. The combined washer and dryer unit as set forth in claim 10, wherein said supporting means comprise a front vertical portion which intersects said lower flange and which flows into a front buttress which joins said upper flange, and a rear vertical portion which extends from said back rib and intersects said lower flange and which flows into a rear buttress member which joins said upper flange.

16. The combined washer and dryer unit as set forth in claim 10, further comprising a plate which cooperates with both mounting brackets.

17. The combined washer and dryer unit as set forth in claim 16, wherein said plate is removable.

18. The combined washer and dryer unit as set forth in claim 16, wherein each of said mounting brackets includes an intermediate rib which extends between the upper flange and said second flange and said plate is secured to said intermediate rib.

19. The combined washer and dryer unit as set forth in claim 10, wherein said lower mounting surface includes means to protect the lower appliance surface from scratches.

20. The combined washer and dryer unit as set forth in claim 19, wherein said means to protect the appliance surface comprises a pad having a pressure-sensitive adhesive layer to join the pad to the lower mounting surface.

* * * * *

UNITED STATES PATENT AND TRADEMARK OFFICE

CERTIFICATE OF CORRECTION

PATENT NO. : 4,680,948

DATED : July 21, 1987

INVENTOR(S) : Raymond W. Rummel & Anthony A. Crystal

It is certified that error appears in the above-identified patent and that said Letters Patent is hereby corrected as shown below:

Column 4, Line 55, "177" should read -- 117 --

Column 5, Line 16, after "and" insert -- the --

Column 8, Line 31, Claim 18, "said second" should read --the lower--

Signed and Sealed this

Twenty-fourth Day of November, 1987

*Attest:*

DONALD J. QUIGG

*Attesting Officer*

*Commissioner of Patents and Trademarks*